US005418593A

United States Patent [19]

Fyson

[11] Patent Number: 5,418,593

[45] Date of Patent: May 23, 1995

[54] HOLLOW ROTARY DRUM PROCESSOR

[75] Inventor: John R. Fyson, Hackney

[73] Assignee: Eastman Kodak Company, Rochester, N.Y.

[21] Appl. No.: 169,084

[22] Filed: Dec. 17, 1993

[30] Foreign Application Priority Data

Dec. 18, 1992 [GB] United Kingdom ..... 9226483

[51] Int. Cl.[6] ..... G03D 3/04

[52] U.S. Cl. ..... 354/330; 354/331

[58] Field of Search ..... 354/298, 299, 312–316, 354/319–324, 331, 328–330, 336; 134/64 P, 64 R, 122 P, 122 R

[56] References Cited

U.S. PATENT DOCUMENTS

| | | | |
|---|---|---|---|
| Re. 34,188 | 3/1993 | Kuzyk et al. | 354/299 |
| 3,581,058 | 5/1971 | Romano | 354/331 |
| 3,698,307 | 10/1972 | Reichart | 354/331 |
| 3,728,953 | 4/1973 | Morse | 354/330 |
| 3,856,395 | 12/1974 | Comstock | 354/331 |
| 4,030,115 | 6/1977 | Perriniaux | 354/331 |
| 4,277,159 | 7/1981 | Descotes | 354/330 |
| 4,922,276 | 5/1990 | Lamprecht et al. | 354/328 |
| 4,954,425 | 9/1990 | Iwano | 430/373 |

FOREIGN PATENT DOCUMENTS 835539 2/1970 Canada .

*Primary Examiner*—D. Rutledge
*Attorney, Agent, or Firm*—Peter J. Bilinski

[57] ABSTRACT

A rotary drum processor (10) having a closed interior which is partly filled with liquid. An electrical immersion heating element (19) is mounted within the drum (10) so that it is always immersed in the liquid. Electrical power is supplied to the heating element (19) through a rotary transformer (24) outside the drum.

10 Claims, 4 Drawing Sheets

HOLLOW ROTARY DRUM PROCESSOR

FIELD OF INVENTION

This invention relates to a hollow rotary drum processor for bringing a pliable sheet of material, such as photographic paper, into contact with a processing liquid, the drum processor having an interior which is partly filled with liquid and which is caused or allowed to be uniformly heated.

BACKGROUND OF THE INVENTION

Up to now, hollow rotary drum processors have been heated by pumping hot water into and out of the drum as the drum is rotated. The hot water may be pumped into the drum and withdrawn from the drum at one end through a pair of co-axial pipes which are formed in a hub of the drum at one end. In another arrangement the hot water may be pumped into the drum through a tubular hub at one end, through and out of the drum at another end via another tubular hub. In both cases a reservoir of hot water must be provided as must a pump. Also there must be provision for sealing against leakage of liquid at the interface between the tubular hub or hubs of the drum and the static conduits leading to the pump and the reservoir.

SUMMARY OF THE INVENTION

According to this invention there is provided a hollow rotary drum processor which has an interior which is partly filled with liquid and which is caused or allowed to be uniformly heated by transmission of energy to it by or through the liquid as it rotates, wherein the interior of the drum processor is closed so that the liquid is entrapped therein and the energy to be transmitted by or through it is imparted to it within the drum processor.

The energy may be heat energy, there being heating means within the drum processor operable to heat the liquid.

The heating means may comprise an electrical immersion heating element mounted within the drum processor so that it is always immersed in the liquid in the drum processor.

The heating means may comprise a pair of spaced electrodes and means operable to cause current to flow between them through the liquid within the drum processor.

In an alternative embodiment of the invention, an electrode may be mounted within the drum processor so as to be electrically insulated from the drum processor which serves as another electrode, and means may be provided for applying an electrical potential between the two electrodes so that current flows between them through the liquid and the energy is electrical.

Conveniently the electrical immersion heating element or the pair of electrodes is connected to an external source of electric power through a rotary transformer outside the drum processor, the rotary transformer comprising a rotary winding carried by an axle of the drum processor and a stationary winding mounted in structure on which the drum processor is journalled, the rotary winding being connected to the heating element or to one of the pair of electrodes through the axle by which it is carried.

There may be heat sensing means operable to limit the amount of heat emitted by the heating means, and the heat sensing means maybe within the drum processor and adapted to operate directly in conjunction with the heating means. Alternatively there may be heat sensing means operable to sense thermal conditions outside the drum processor related to the state of heating of the drum processor, the heat sensing means being operable to control the heating of the drum processor by controlling the connection of the external source of power through the rotary transformer.

The internal surface of the drum processor maybe configured so as to effect agitation of the liquid within the drum processor as it rotates.

One form of rotary drum..processor apparatus in which this invention is embodied, and several modifications thereof, are described now by way of example with reference to the accompanying drawings, of which:

DESCRIPTION OF THE INVENTION

Figure 1:
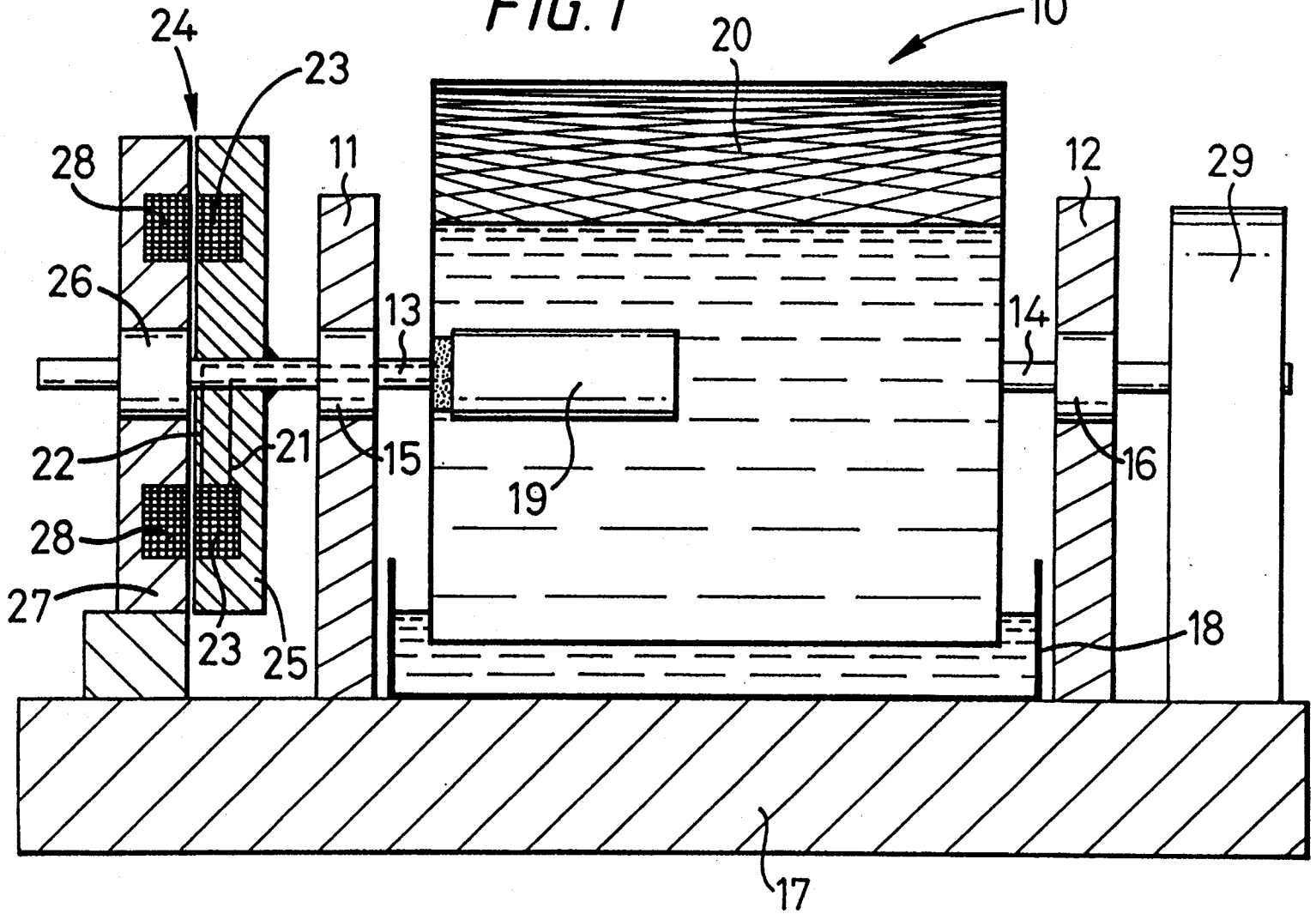
FIG. 1 is a diagrammatic cross-section of the rotary drum processor apparatus.

FIG. 1 shows a cylindrical drum processor 10 is supported for rotation about its axis between a pair of upright bearing supports 11 and 12 by having an axle 13,14 at either end journalled in a respective bearing 15,16 mounted in a respective one of the bearing supports 11 and 12. The bearing supports 11 and 12 are mounted on base structure 17. The bottom part of the drum processor 10 is immersed in processing solution in an open topped bath 18 placed on the base structure 17 between the bearing supports 11 and 12. An exposed photographic print to be processed is laid on the external surface of the drum.

The drum processor 10 is hollow and its interior is closed in the sense of being liquid tight. It is partly filled, being more than half filled with a heat conducting liquid such as water or silicon oil.

The internal cylindrical surface of the drum processor 10 is patterned (as is shown diagrammatically at 20) in order to agitate the liquid within the drum processor 10 as the latter rotates.

An electrical immersion heater 19 of the type commonly used to heat fish tanks, is mounted in the drum processor 10 and suspended within the interior of the drum processor 10, at or adjacent to the axis of the drum processor 10 so that it is always immersed in the liquid in the drum processor 10. The heater 19 has a built-in thermostat which is set to control operation of the heater 19 so as to maintain the required process temperature. The electrical leads 21 and 22 of the heater 19 are led through appropriate conduits formed in the axle 13 and are connected to respective terminals of a rotary winding 23 of a rotary transformer 24, the rotary winding 23 being mounted in a soft iron core 25 which is fixed to the axle 13 on the opposite side of the bearing support 11 from the drum processor 10, so as to rotate therewith. The rotary winding 23 is located in an annular groove in a vertical face of the soft iron core 25 remote from the drum processor 10. The leads 21 and 22 are led through appropriate liquid seals which seal against leakage of liquid from within the drum processor 10 through the conduits in the axle 13.

It is safer to use silicon oil rather than water because it is a poor conductor of electricity. The drum processor 10 is not completely filled with the heat conducting liquid in order to allow for expansion of the liquid and to avoid any risk of bursting of the drum processor 10. A blow out cap could be fitted to cater for excessive expansion of liquid due to overheating which might otherwise cause the drum to burst.

The axle 13 projects through the rotary soft iron core 25 and is journalled in another bearing 26 which is mounted in another soft iron core 27 which in turn is mounted on the base structure 17. There is as small a gap as is possible between the juxtaposed faces of the two soft iron cores 25 and 27 which are both vertical. The stationary winding 28 of the rotary transformer 24 is located in an annular groove formed in the vertical face of the soft iron core 27 that is close to the soft iron core 25, and its terminals are for connection to a suitable AC power supply. The use of soft iron cores enables mains electricity to be used with little power loss.

When the rotary drum processor apparatus is to be used, the stationary winding 28 is connected to the AC power supply and the drum processor 10 is rotated about its axis by a motor 29 which drives the axle 14. A voltage is induced in the rotary winding 23 by the action of the rotary transformer 24 and that voltage is applied to the heater 19 via the leads 21 and 22. As a result the liquid in the drum processor 10 is heated up, as is the drum processor 10 itself by conduction and convection of heat through the liquid. The rotation of the drum processor 10 causes the liquid to be stirred and that is supplemented by the agitation of the liquid induced by the patterned internal surface 20 of the drum processor 10. That leads to the drum processor 10 being heated uniformly. When the required state of thermal equilibrium has been reached by the action of the thermostat on the heater 19, the apparatus is ready for processing to begin.

Figure 2:
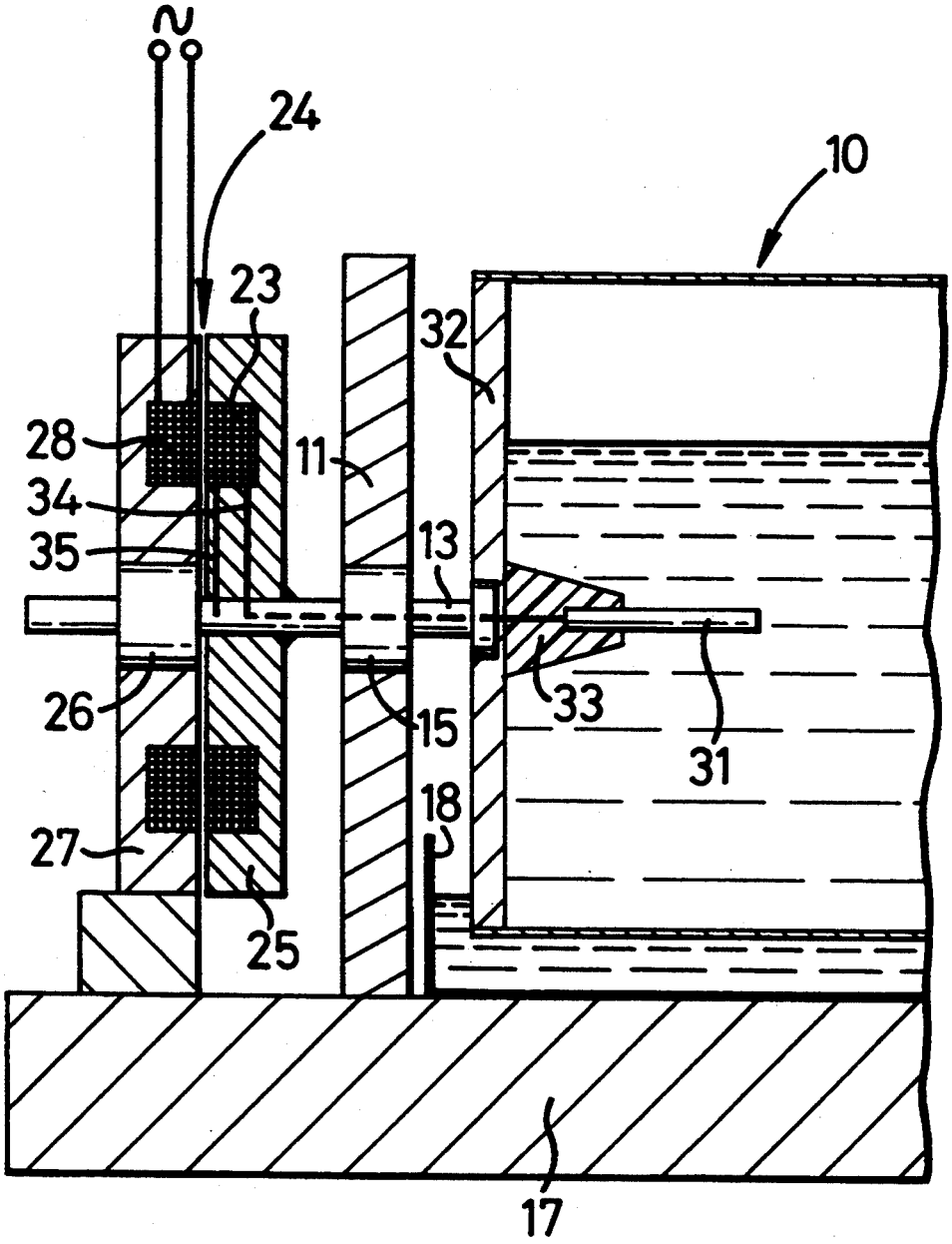
FIG. 2 is a partial view of rotary drum processor apparatus similar to that shown in FIG. 1 but incorporating a different heating arrangement.

Instead of heating the drum processor 10 indirectly by heating the liquid in it, it is possible to heat the drum processor 10 by passing current directly through the liquid between two electrodes. FIG. 2 shows such an arrangement. One electrode 31 is mounted immersed in the liquid in place of the heater 19. The drum 10 is used as the other electrode. The electrode 31 is mounted on an end wall 32 of the drum 10 by an insulator 33. The electrode 31 is connected to a terminal of the rotary winding 23 of the rotary transformer by an insulated lead 34. The other terminal of the rotary winding 23 is connected to the axle 13 by another insulated lead 35. The electrical potential supplied from the rotary transformer 24 would need to be low.

Figure 3:
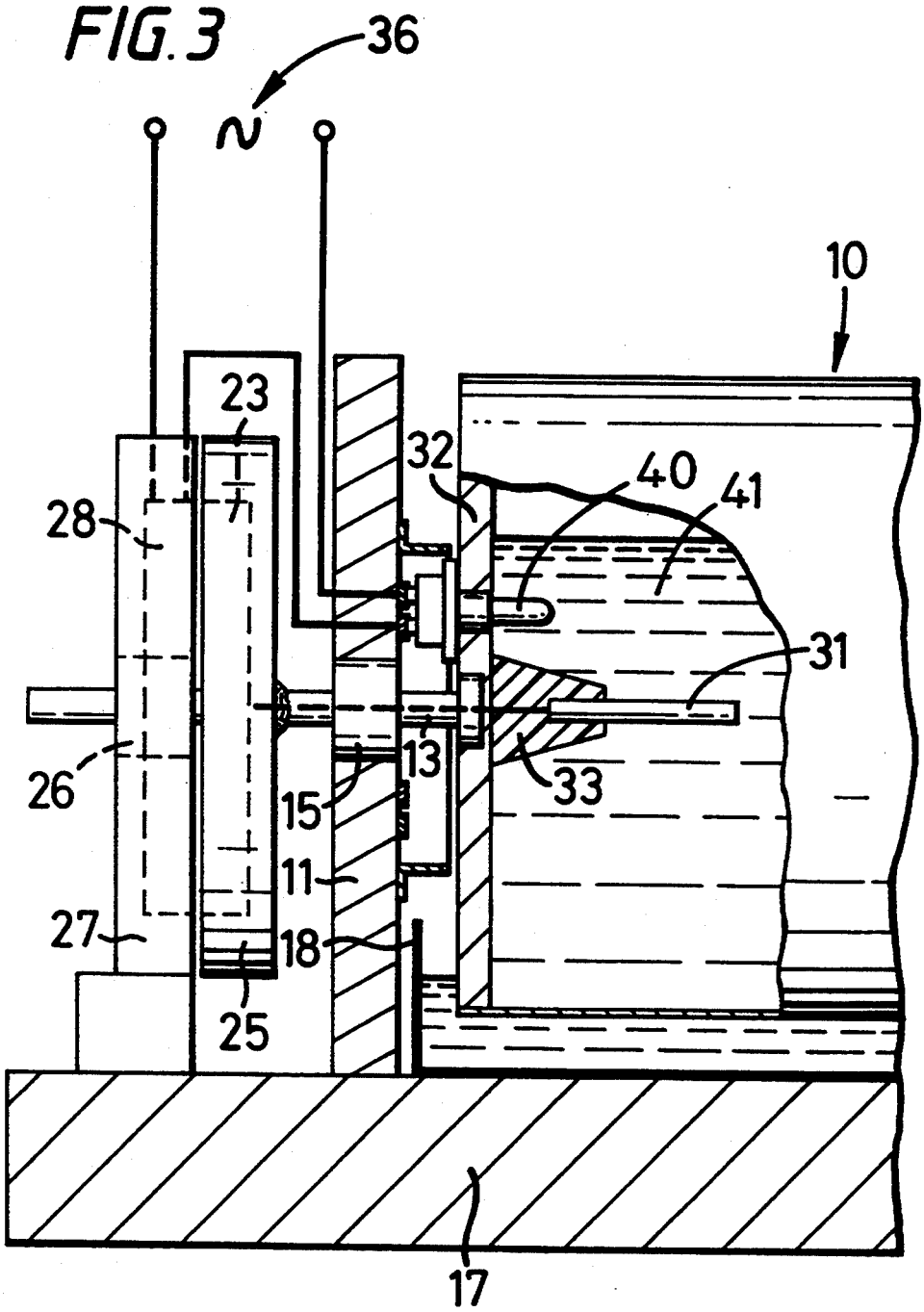
FIG. 3 is a partially cut-away elevation otherwise similar to FIG. 2 but showing another modification.
Figure 4:
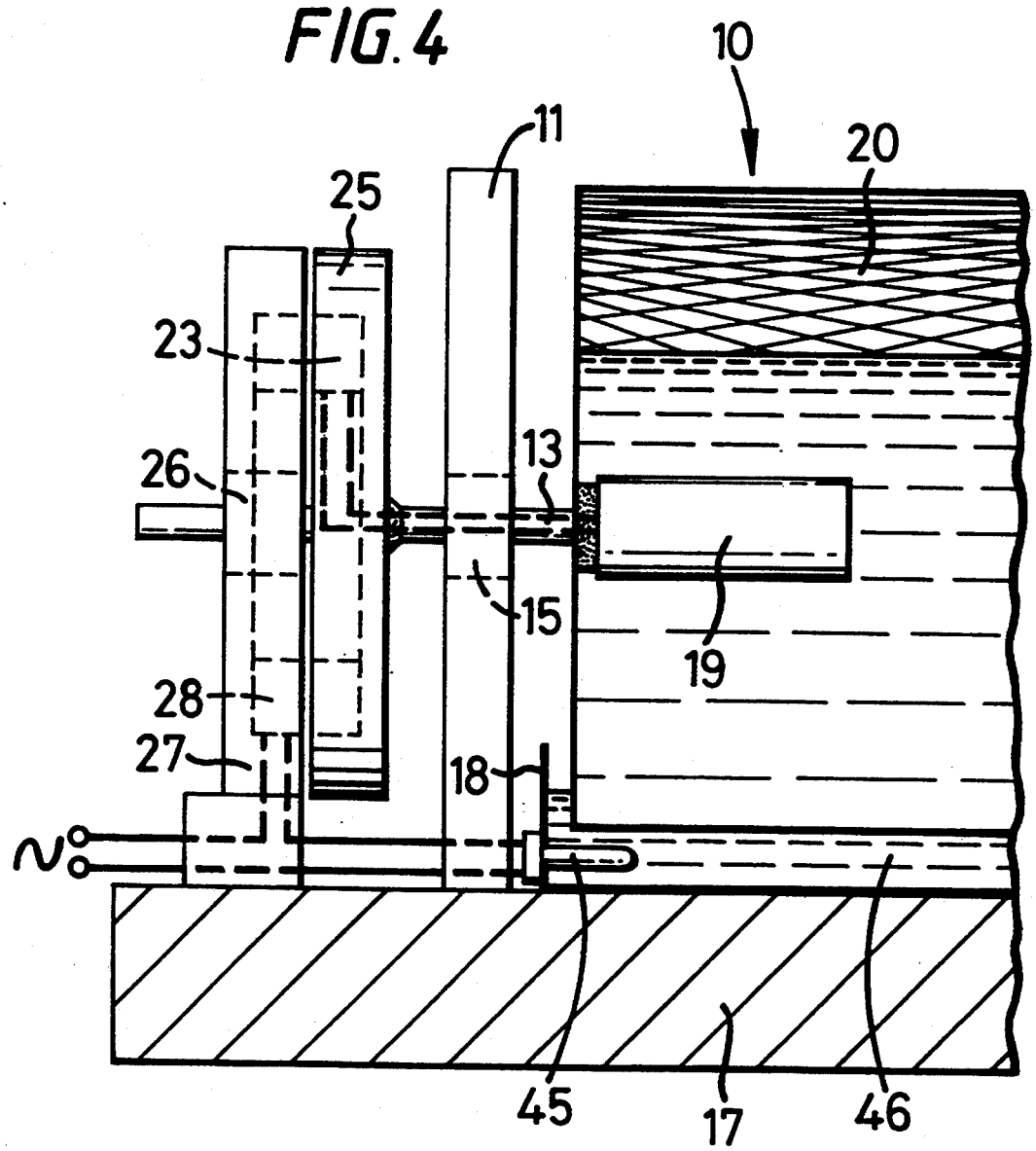
FIG. 4 is a partial elevation, similar to FIG. 3, showing a further modification.

Instead of using the thermostat that is built into the heater 19, as described, or when the liquid is heated by passing current directly through it, as is described above with reference to FIG. 2, a separate heat sensing device 40 (see FIG. 3) which may be a thermostat or a bi-metallic device, may be immersed in the liquid 41 separately from the electrode 31 (or the heater 19) and arranged to control the heating to maintain the required temperature of the liquid. FIG. 3 shows the heat sensing device 40 connected between the stationary winding 28 and the power supply 36 through slip rings. Alternatively a heat sensor which is in sliding contact with the external surface of the drum processor 10, or which, as is shown at 45 in FIG. 4, is immersed in the processing solution 46 in the bath 18, may be provided. Such an external heat sensor maybe arranged to control the supply of power to the stationary winding 28 in order to maintain the temperature of the drum processor 10 or of the processing solution 46 in the bath 18 at the required level.

I claim:

1. A rotary drum processor for processing photographic material comprising;

a hollow cylindrical drum having a sealed interior chamber, an exterior surface and an axis of rotation, said chamber containing a liquid, said liquid being heated so as to transmit energy for uniformly heating the drum;

mounting means for mounting the drum for rotating the drum about the axis; and a reservoir containing processing solution located beneath the drum, such that a portion of the drum comes in contact with the processing solution, the photographic material being in contact with the exterior surface of at least the portion of the drum which is in contact with the processing solution.

2. A hollow rotary drum processor (10) according to claim 1, including heating means (19) within the drum processor (10), the heating means (19) being operable to heat the liquid so that the energy to be transmitted is heat energy.

3. A hollow rotary drum processor (10) according to claim 2, wherein the heating means is an electrical immersion heating element (19) which is mounted within the interior chamber of the drum processor (10) so that the element (19) is always immersed in the liquid.

4. A hollow rotary drum processor (10) according to claim 2 wherein the heating means comprise a pair of spaced electrodes (31 and 32) and means (24,34 and 36) operable to cause current to flow between the pair of electrodes (31 and 32) through the liquid within the drum processor (10).

5. A hollow rotary drum processor (10) according to claim 1, including an electrode (31) which is mounted within the interior chamber of the drum processor (10) so as to be electrically insulated from the drum processor (10) which serves as another electrode (32), and means (24,34 and 36) for applying an electrical potential between the two electrodes (31 and 32) so that current flows between the two electrodes (31 and 32) through the liquid wherein the energy to be transmitted to the drum is electrical.

6. A hollow rotary drum processor (10) according to any one of claims 3 to 5, wherein the electrical immersion heating element (19) or the pair of electrodes (31 and 32) is connected to an external source (36) of electric power through a rotary transformer (24) outside the drum processor (10), the rotary transformer (24) comprising a rotary winding (23) carried by an axle (13) of the drum processor (10) and a stationary winding (28) mounted in structure (17,27) on which the drum processor (10) is journalled, the rotary winding (23) being connected to the heating element (19) or to one (31) of the pair of electrodes (31 and 32) through the axle (13) by which it is carried.

7. A hollow rotary drum processor (10) according to claim 2, including heat sensing means (40) operable to limit the amount of heat emitted by the heating means (19,31 and 32).

8. A hollow rotary drum processor (10) according to claim 7 wherein the heat sensing means (40) is within the interior chamber of the drum processor (10) and is adapted to operate directly in conjunction with the heating means (19,31 and 32).

9. A hollow rotary drum processor (10) according to claim 6, including heat sensing means (45) operable to sense thermal conditions outside the drum processor (10) related to the state of heating of the drum processor (10), said heat sensing means (45) being operable to control the heating of the drum processor (10) by controlling the connection of the external source of power (36) through the rotary transformer (24) .

10. A hollow rotary drum processor (10) according to claim 1, wherein an internal surface (20) of the drum processor (10) is configured so as to effect agitation of the liquid within the interior chamber of the drum processor (10) as it rotates.

* * * * *